US005970638A

United States Patent [19]

Henley

[11] Patent Number: 5,970,638

[45] Date of Patent: Oct. 26, 1999

[54] SEALED ORNAMENT

[76] Inventor: Lorinda B. Henley, P.O. Box 60076, Bakersfield, Calif. 93386

[21] Appl. No.: 09/027,753

[22] Filed: Feb. 23, 1998

[51] Int. Cl.[6] ..... G09F 7/12; G09F 21/04

[52] U.S. Cl. ..... 40/594; 40/593; 40/675; 40/661; 40/771; 40/638

[58] Field of Search ..... 40/594, 595, 593, 40/737, 675, 661, 771, 638; 428/14

[56] References Cited

U.S. PATENT DOCUMENTS

| | | | |
|---|---|---|---|
| 1,922,767 | 8/1933 | Humphner | 40/638 |
| 3,849,913 | 11/1974 | Williams, Sr. | 40/594 X |
| 4,305,216 | 12/1981 | Skelton | 40/644 |
| 4,864,755 | 9/1989 | Owens | 40/661 X |
| 5,074,593 | 12/1991 | Grosso | 40/661 X |
| 5,248,536 | 9/1993 | Du Katz | 40/594 X |
| 5,388,353 | 2/1995 | Givnan | 40/737 |
| 5,443,869 | 8/1995 | Harris | 40/638 X |

FOREIGN PATENT DOCUMENTS

| | | | |
|---|---|---|---|
| 2231551 | 11/1990 | United Kingdom | 40/594 |

*Primary Examiner*—Terry Lee Melius
*Assistant Examiner*—Rodrigo J. Morales
*Attorney, Agent, or Firm*—Jack C. Munro

[57] ABSTRACT

An object, such as a dried and pressed flower, is to be mounted between a transparent electrostatic vinyl sheet and a cover film with the object being tightly sealed therebetween. The electrical properties of the electrostatic vinyl film are to permit the resulting sealed ornament to be applied onto a clean, flat, non-porous surface with the static electricity of the electrostatic vinyl film fixing the sealed ornament in position.

6 Claims, 1 Drawing Sheet

SEALED ORNAMENT

BACKGROUND OF THE INVENTION

1) Field of the Invention

The field of this invention relates to ornaments, more particularly to an ornament which is constructed in a sheet material form with the ornament comprising a displayable item secured between thin, transparent, flexible plastic sheets of material.

2) Description of the Prior Art

Ornaments are numerous in configuration. A typical object to be utilized to construct an ornament could be a photograph, a drawing, a small painting, and even natural items such as dried and pressed flowers. It has been known to seal objects between transparent layers of plastic with the transparent plastic layer permitting the visualization of that object. The ornament is then to be secured by some type of securing means onto a surface with it being common that this surface is located vertically. Commonly used securing means would include an adhesive or a nail. Some of the disadvantages of such types of securing means are that nails leave marks and an adhesive usually leaves a residue on the surface to which the ornament is applied. This residue would detract from the physical appearance of the surface upon the sealed ornament being removed and possibly moved to another location. Also, any nail hole would mar the physical appearance of the surface.

SUMMARY OF THE INVENTION

The subject invention is a sealed ornament constructed in one embodiment of a sheet material vinyl layer having an inner side and an outer side. The outer side of the vinyl layer is electrostatic. The inner side has a first layer of adhesive. The object is to be placed on the inner side with the object being smaller in size than the vinyl layer. A transparent cover film is placed on the object and the inner side of the vinyl layer. The transparent cover film is secured in position on the object and the transparent layer. In another embodiment of this invention there is placed a double-sided adhesive sheet between the vinyl layer and the object which is also between the vinyl layer and the transparent cover film. The resulting sealed ornament of this invention is to be pressed firmly and evenly onto a clean, flat, non-porous surface with the electrostatic layer functioning to fixedly position the sealed ornament in position on the clean, flat, non-porous surface. Prior to usage of the sealed ornament, the electrostatic layer is protected by a backing layer which is to be removed when the ornament is to be applied to the clean, flat, non-porous surface.

One of the primary objectives of the present invention is to construct a sealed ornament which can be applied to any clean, flat, non-porous surface and will remain in position on that clean, flat, non-porous surface for as long as desired.

Another objective of the present invention is to construct a sealed ornament which can be readily removed from the surface to which it is applied and upon removal leaves no mark on the surface.

Another objective of the present invention is to construct a sealed ornament which is attractive and works effectively in conjunction with natural items such as dried and pressed flowers.

Another objective of the present invention is to construct a sealed ornament which can be manufactured inexpensively and thereby sold to the ultimate consumer for a reasonable price.

DETAILED DESCRIPTION OF THE PREFERRED EMBODIMENTS

Figure 1:
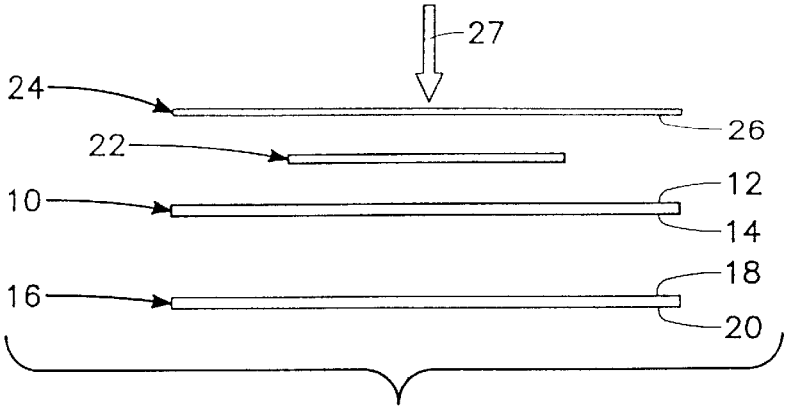
FIG. 1 is an exploded side elevational view of the first embodiment of the sealed ornament of this invention.

Referring particularly to the drawing, there is shown in FIG. 1 the first embodiment of the sealed ornament of this invention. The first embodiment utilizes a double-sided, pressure sensitive, adhesive sheet 10 which is basically planar, thin and formed of transparent plastic material. Typically the sheet 10 will comprise a polyester carrier which is coated on the top side 12 and the bottom side 14 with adhesive. Typical material for the adhesive on the top side 12 and bottom side 14 would be an acrylic. Generally, the thickness of the sheet 10 would be no more than a few thousandths (mil) of an inch.

A vinyl layer 16 is also utilized which is transparent. The vinyl layer 16 has an inner side 18 and an outer side 20. The outer side 20 is electrostatic. It is a known phenomenon for static electricity to have an adhering quality. This quality is being utilized in this invention. The typical material of construction for the sheet 16 would be a polyvinyl chloride. Such an electrostatic vinyl material 16 is commonly sold under the trademark PENSTICK.

The bottom side 14 and the double-sided adhesive sheet 10 is to be placed in contact with the inner side 18. It is the function of the adhesive on the bottom side 14 to securely mount the sheet 16 in relation to the sheet 10. An object 22, such as a dried pressed flower, is to be placed against the top side 12 and is to be adhesively secured thereto by the adhesive located on the top side 12. The object 22 is to be flattened against the sheet 10 to assure that the object 22 is tightly positioned against the sheet 10. It is to be understood that the object 22 can assume numerous configurations and not be restricted to a dried pressed flower.

Applied onto the object 22 is a cover film 24. The thickness of the cover film 24 is generally about two mils. Typical material of construction for the cover film 24 would be a polyvinyl chloride. The inside surface 26 of the cover film 24 also includes a layer of adhesive. Physical pressure is to be applied in the direction of arrow 27 which tends to compress the cover film 24, the object 22, and sheets 10 and 16 forming a sandwiched structure known as the sealed ornament 28. This compressing removes air bubbles and a single unitary appearing structure is produced. It is desirable to eliminate any air bubble as such would distract from the appearance of the sealed ornament 28. It is important that all the sheets 10 and 16 and cover film 24 be transparent so that both the front side and the back side of the object 22 can be readily observed.

Figure 2:
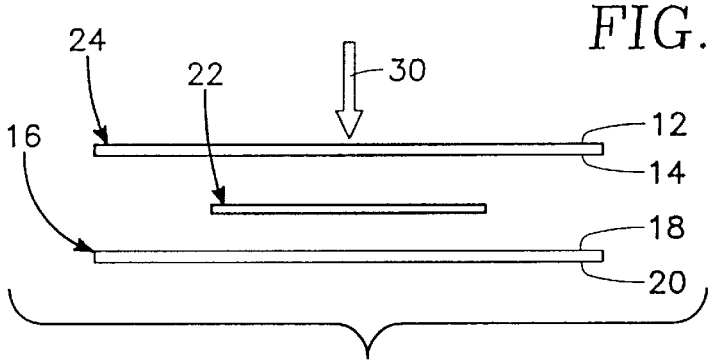
FIG. 2 is an exploded, side elevational view of the second embodiment of the sealed ornament of this invention.
Figure 3:
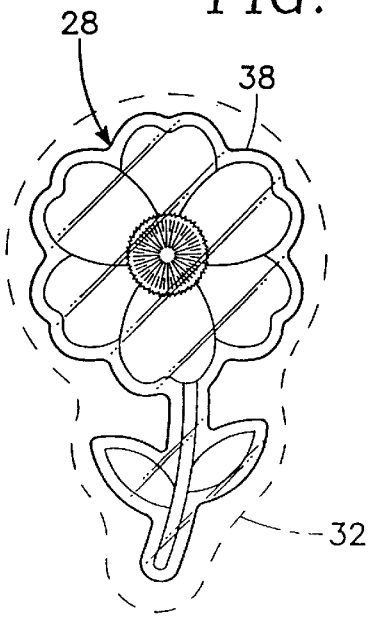
FIG. 3 is a top plan view of a sealed ornament which is constructed by either the first embodiment or the second embodiment of this invention.
Figure 4:
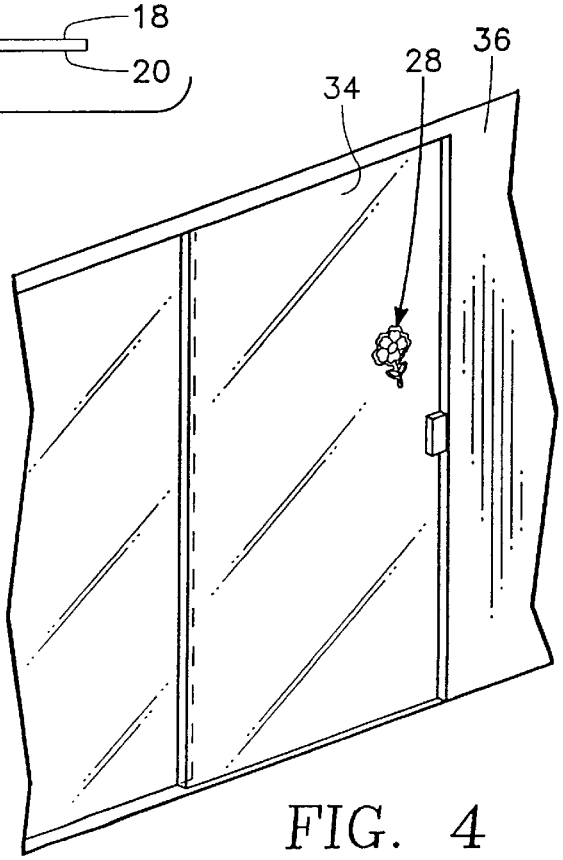
FIG. 4 is a view depicting application of the sealed ornament of this invention onto a typical clean, flat surface such as a sliding glass door.

Referring particularly to FIG. 2, like numerals have been employed to refer to like parts. The main distinction of FIG. 2 from FIG. 1 is that the double-sided adhesive sheet 10 has been eliminated and an adhesive layer on inner side 18 and an adhesive layer on bottom side 14 is to be used in lieu of the sheet 10. The sandwiched structure of the ornament of FIG. 2 is to be again produced by pressing together of the different layers in the direction of arrow 30.

Prior to usage of sealed ornament 28 in FIG. 1 or FIG. 2, the electrostatic surface of the outer side 20 is to be protected by means of a backing sheet 32. The backing sheet 32 is to maintain the electrostatic nature of the outer side 20. Prior to usage of the sealed ornament 28, the backing sheet 32 is to be removed with the electrostatic outer side 20 of the sealed ornament 28 to be placed against a clean, flat, non-porous surface such as a sliding glass door 34 which is mounted within a wall 36 of a house or building. The sheets 10 and 16 and cover film 24 that make up the sealed ornament 28 are to be cut forming a peripheral edge 38 which closely conforms to the shape of the object 22. It is to be understood that the peripheral edge 38 would, of course, vary on ornaments of different shapes.

What is claimed is:

1. A sealed ornament comprising:

a sheet material body, said body being constructed of a double-sided adhesive sheet having a top side and a bottom side, said top side having a first adhesive layer, said bottom side having a second adhesive layer;

an object placed on said first adhesive layer resulting in said object being secured in position to said double-sided adhesive sheet, said object being smaller in size than said double-sided adhesive sheet, said object having a peripheral edge;

a transparent cover film placed on said first adhesive layer completely covering said object and extending beyond said peripheral edge along the entire length of said peripheral edge, said cover film being tightly sealed to said first adhesive layer encasing said object, said object being observable through said transparent cover film; and an electrostatic vinyl sheet being secured to said second adhesive layer, whereby said vinyl sheet is adopted to be pressed firmly and evenly onto a clean, flat, non-porous surface which will result in said sealed ornament being fixed in position on the clean, flat, non-porous surface with the sealed ornament being held in place by the electrical properties of said electrostatic vinyl sheet.

2. The sealed ornament as defined in claim 1 wherein:

said sheet material body being transparent, whereby said object can be observed through said sheet material body.

3. The sealed ornament as defined in claim 1 wherein:

said cover film having an adhesive layer, said adhesive layer being applied against said object and said first adhesive layer.

4. The sealed ornament as defined in claim 1 wherein:

said electrostatic vinyl sheet being transparent whereby said object is observable through said electrostatic vinyl sheet.

5. The sealed ornament as defined in claim 1 wherein:

said sealed ornament being repositionable from one clean, flat, non-porous surface to another clean, flat, non-porous surface.

6. The sealed ornament as defined in claim 1 comprising:

a backing layer, said backing layer to be located against said outer side of said vinyl sheet, said backing layer to be removed upon application of said sealed ornament onto the clean, flat, non-porous surface.

* * * * *